US010648306B2

(12) United States Patent
Wallace et al.

(10) Patent No.: US 10,648,306 B2
(45) Date of Patent: May 12, 2020

(54) INTERVAL DELIVERY OF LIQUID CARBON DIOXIDE

(71) Applicant: ARIZONA CO2 SOLUTIONS LLC, Chandler, AZ (US)

(72) Inventors: Matthew Wallace, Tucson, AZ (US); John T. Wilson, Chandler, AZ (US)

(73) Assignee: ARIZONA CO2 SOLUTIONS LLC, Chandler, AZ (US)

( * ) Notice: Subject to any disclaimer, the term of this patent is extended or adjusted under 35 U.S.C. 154(b) by 0 days.

(21) Appl. No.: 16/418,736

(22) Filed: May 21, 2019

(65) Prior Publication Data

US 2020/0011163 A1 Jan. 9, 2020

Related U.S. Application Data

(60) Provisional application No. 62/694,613, filed on Jul. 6, 2018.

(51) Int. Cl.
*E21B 43/16* (2006.01)
*E03B 3/12* (2006.01)

(52) U.S. Cl.
CPC ..... *E21B 43/164* (2013.01); *E03B 3/12* (2013.01)

(58) Field of Classification Search
CPC ..... E21B 37/00
See application file for complete search history.

(56) References Cited

U.S. PATENT DOCUMENTS

| | | | | |
|---|---|---|---|---|
| 1,510,581 | A * | 10/1924 | Boynton | E21B 33/124 166/185 |
| 3,083,775 | A * | 4/1963 | Henderson | E21B 33/12 277/342 |
| 7,337,845 | B1 * | 3/2008 | Mansuy | E21B 37/00 166/263 |
| 9,097,092 | B2 * | 8/2015 | Gillan | E21B 33/12 |
| 2004/0256104 | A1 * | 12/2004 | Wilson | C09K 8/52 166/302 |

* cited by examiner

*Primary Examiner* — William D Hutton, Jr.
*Assistant Examiner* — Avi T Skaist
(74) *Attorney, Agent, or Firm* — Snell & Wilmer, L.L.P.

(57) ABSTRACT

The system delivers liquid CO2 125 into the casing screened interval of an eductor pipe 110 within a water well. The eductor pipe 110 assembly extends from the top of the well (or land surface) to the top of a disk interval isolation assembly 123. The disk assembly isolates a predetermined length of screened interval, so liquid CO2 125 can be injected and contained within the interval and immediately outside the casing.

19 Claims, 4 Drawing Sheets

INTERVAL DELIVERY OF LIQUID CARBON DIOXIDE

CROSS-REFERENCE TO RELATED APPLICATIONS

This application claims priority to and the benefit of U.S. Provisional Application Ser. No. 62/694,613 filed Jul. 6, 2018 and entitled "INTERVAL DELIVERY OF LIQUID CARBON DIOXIDE," which is incorporated herein by reference in its entirety for all purposes.

FIELD

This disclosure generally relates to cleaning casings of water wells, and more particularly, to treating casings of water wells with liquid CO2 using an interval isolation assembly.

BACKGROUND

CO2 exists in three states, namely gas, liquid and solid. Gaseous CO2 has a specific gravity of 1.53 which makes it heavier than air. Compressing and cooling CO2 gas produces liquid CO2 125. Depressurizing and warming liquid CO2 125 will rapidly transform the liquid to a solid form. Solid CO2 is commonly referred to as dry ice. Dry ice sublimates back to the natural gaseous state. In that regard, sublimation energy can be harnessed for mechanical work.

Liquid Carbon Dioxide (CO2) has long been utilized in the oil industry for well development and rehabilitation. The chemical and physical reactions that occur when liquid CO2 125 interacts with fluids within the confines of a well include, for example, dissolving oil residue by the formation of carbonic acid, removing deposits through mechanical sublimation and pressurization due to sublimation, forcing CO2 through fractures within the oil bearing formation to open pathways for increased oil production.

Groundwater wells (wells) are drilled and lined with casing materials. Casing of well 105 is typically perforated or screened at or below the groundwater level and extends to bottom of the casing to allow water to enter and accumulate. The entire perforated or screened section of the water casing of well 105 and the annulus immediately outside the casing of well 105 is often treated with liquid CO2 125. However, treating the entire screened section simultaneously is not efficient, safe or entirely effective. Rock or sediments penetrated during drilling are rarely homogenous. Water yield is higher through fractured rock or large grained sands and gravels. However, less permeable zones still are important to water production wells. When the entire screened interval of a well is treated with liquid CO2 125, it will preferentially move out of the screen through the more permeable strata, leaving the less permeable zones outside of the perforated or screened casing 115 untreated. Increasing CO2 pressure would help treat less permeable zones outside of the casing of well 105, but over pressurizing a casing of unknown age or condition would create a safety issue. In addition, while attempting to treat lower permeable zones with increased pressure, large volumes of CO2 would escape through the more permeable zones lowering the efficiency.

SUMMARY

In various embodiments, the system includes an interval isolation assembly comprising an eductor pipe within a water well having a well wall; an upper disk forming an upper boundary between the eductor pipe and the well wall; a lower disk forming a lower boundary between the eductor pipe and the well wall; and the upper disk and the lower disk isolating liquid CO2 around a portion of the eductor pipe.

The portion of the eductor pipe may include a perforated wall. The upper disk may include a rubber disk between two steel plates. The upper disk may include a rubber disk between two steel plates, wherein the rubber disc has a larger diameter than the two steel plates. The upper disk may include a rubber disk that provides a seal during injection of the liquid CO2. The upper disk may include a rubber disk that cups up and down against the well wall. The upper disk and the lower disk may translate along the eductor pipe. The eductor pipe may receive a center of the upper disk and a center of the lower disk.

The system may also include a supply line that supplies the liquid CO2 into the eductor pipe. The liquid CO2 may emanate from the eductor pipe between the upper disk and the lower disk. The system may also include a diverter tree within a top of the water well. A gas diverter pipe may emanate from the well and/or from the diverter tree within a top of the well. The system may also include one or more of an exhaust valve, a pressure gauge in an injection pipe that provides the liquid CO2, a flow valve in an injection pipe that provides the liquid CO2 and/or a flow meter in an injection pipe that provides the liquid CO2.

The method may comprise injecting liquid CO2 into a screened portion of an eductor pipe between an upper disk and a lower disk within a first section of a well; and injecting liquid CO2 into the screened portion of the eductor pipe between the upper disk and the lower disk within a second section of the well. The method may further comprise moving the screened portion of the educator pipe toward the surface of the well by shortening the eductor pipe from the surface of the well. The method may further comprise relieving pressure in the eductor pipe.

BRIEF DESCRIPTION OF THE DRAWINGS

The subject matter of the present disclosure is particularly pointed out and distinctly claimed in the concluding portion of the specification. A more complete understanding of the present disclosure may be obtained by referring to the detailed description and claims when considered in connection with the drawing figures, wherein like numerals denote like elements. Each of the various Figures and components may be in accordance with various embodiments of the disclosure.

DETAILED DESCRIPTION

The features and elements discussed herein may be combined in various combinations without exclusivity, unless expressly indicated herein otherwise. These features and elements as well as the operation of the disclosed embodiments will become more apparent in light of the following description and the accompanying figures. The detailed description of various embodiments herein refers to the accompanying drawings and pictures, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
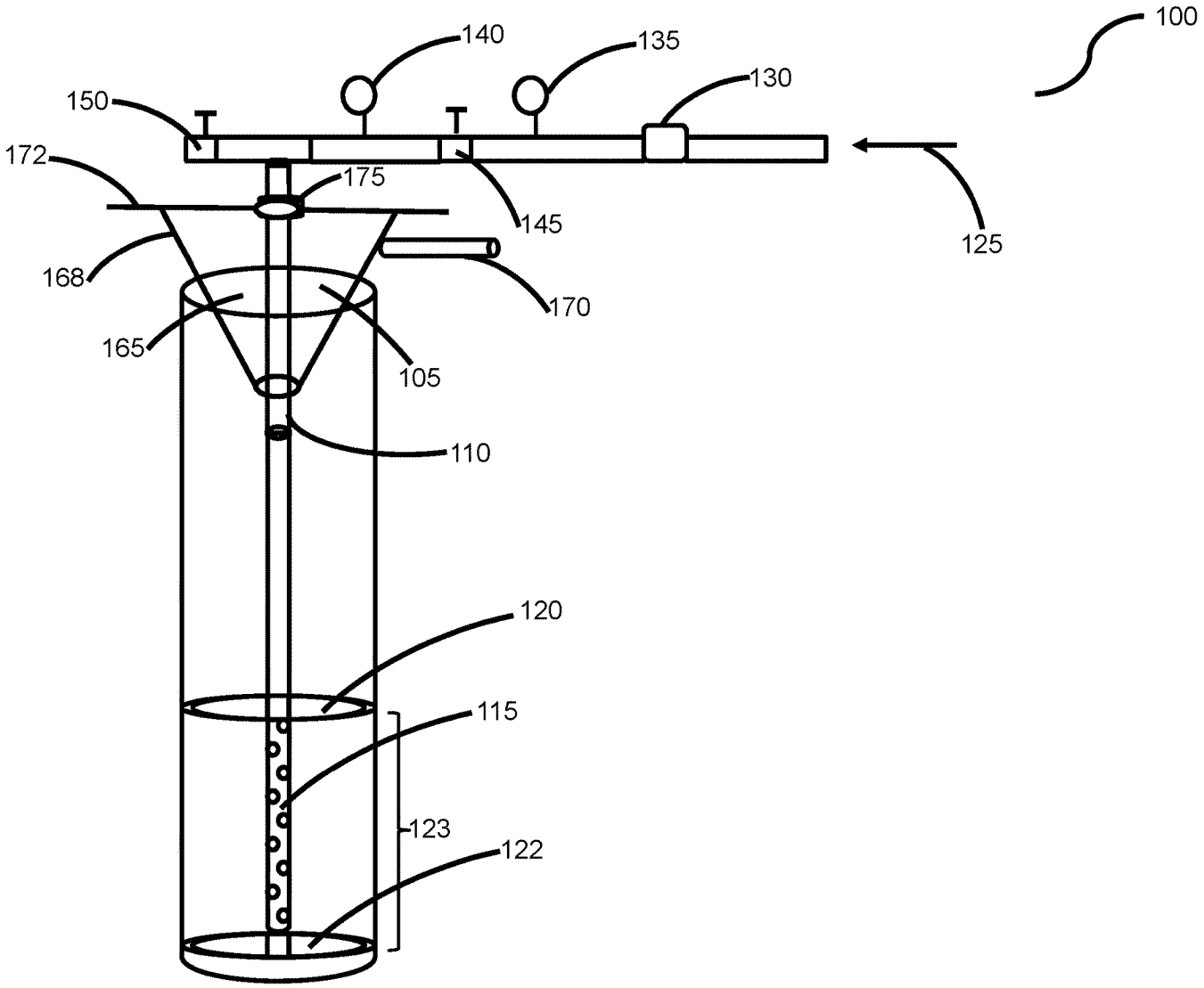
FIG. 1 shows the various components of the water treatment system, in accordance with various embodiments.

In general, and as set forth in FIG. 1 and in various embodiments, system 100 may include liquid CO2 125 delivered into the screened casing 115 portion of the well 105 through an eductor pipe 110. The eductor pipe 110 assembly extends from the top of the well 105 (or land surface) to the top of a disk interval isolation assembly 123. The disk interval isolation assembly 123 isolates a certain interval of screened casing 115, so liquid CO2 125 can be injected and contained within the interval and within a certain distance from the outside of the casing.

Sublimation of liquid CO2 125 creates chemical and mechanical processes that enhance production and increase efficiency in water wells. The low temperature of CO2 kills certain bacteria, while CO2 gas mixing with water forms a mild carbonic acid. In various embodiments, the system and method include treating a screened casing 115 section of an eductor pipe 110 and annulus around the screened casing 115 in certain intervals. With respect to the annulus, the drilled borehole is generally larger than the casing. The space between the casing and the borehole is referred to as the annulus. The annulus is left open to be backfilled naturally or filled with gravel larger than the opening or perforations in the casing. The amount of treatment may be based on the volume of the screened casing 115. In various embodiments, any portion of the screened casing 115 of eductor pipe 110 may be treated in any order. For example, the screened casing 115 of eductor pipe 110 may treated from the bottom (furthest away from the land surface) of the screened section to the top (closest to the land surface) of the screened section.

In various embodiments, the volume of the casing is based on the length of the screened casing 115 section and the diameter of the casing of well 105. The system may also introduce extra volume of liquid CO2 125 outside of the casing of well 105. For example, the liquid CO2 may extend outside of the well casing an extra amount equal to about 25% of the radius of the well casing diameter. The volume of liquid CO2 125 injected into the screened casing 115 interval, between the disks 120, 122, is calculated by considering one or more of the pressure and the volume needed to fill the eductor pipe 110; the pressure to evacuate the groundwater column inside the eductor pipe 110 and the about 1.25 times volume of the screened casing 115 interval. An exemplary equation may include Pressure (PSI)=0.433*[height of water column]*[specific gravity of water]. The volume of liquid CO2 125 injected per interval may be constant, but as the disk interval isolation assembly 123 is raised, the eductor pipe 110 is reduced due to removing pipe from the string of pipes. Less pressure is needed because less water pressure exists in the higher areas near the top of the well. In other words, as the height of the water column gets smaller, the amount of pressure required to displace the water column is reduced. Therefore, the pressure and volume of the liquid CO2 125 may be reduced in the higher areas near the top of the well.

In various embodiments, and as set forth in FIG. 1, the injection assembly system 100 on the land surface may consist of liquid CO2 125 flowing under pressure from a stationary or portable storage vessel, through a cryogenic flow meter 130, through a flow controlling valve 145 and into the eductor pipe 110. Pressure gauges 135, 140 capable of recording calculated pressures may be mounted on one side or both sides of the flow controlling valve 145 to record vessel pressure and downhole pressure. The injection assembly system 100 may also include exhaust piping controlled by an exhaust valve 150, wherein the exhaust piping may provide for exhaust of the gases from the well.

In various embodiments, and with continued reference to FIG. 1, the eductor pipe 110 may run through a diverter tree 165. The use of diverter tree 165 may depend on the type and/or size of the well 105. The diverter tree 165 may be mounted on the wellhead. The diverter tree 165 is designed to support the weight of the eductor pipe 110 hanging in the well 105. The diverter tree 165 may include a funnel portion 168 and a cover over the top of the funnel portion 168. The cover 172 may include an opening to allow the piping to go through the cover 172 and down the funnel portion 168, out the bottom of the funnel portion 168 and into the well 105. For example, the opening at the bottom of the funnel may be about 8 inches in diameter, and the eductor pipe 110 may be only 2 inches in diameter. The opening in the cover 172 of the diverter tree 165 may include a wiper 175. The wiper 175 may be any device to provide a suitable seal between the eductor pipe 110 and the opening in the cover 172 of the diverter tree 165. For example, the wiper 175 may comprise a rubber ring with an outside circumference mating with the circumference of the opening in the cover 172 of the diverter tree 165. The rubber ring may comprise an inside circumference that abuts the eductor pipe 110 to provide a seal around the eductor pipe 110 that restricts the escape of gas or fluid. The diverter tree 165 does not need to seal the wellhead because the diverter tree 165 re-directs excess pressure outside of the well 105. For example, the diverter tree 165 may divert CO2 gas (via the CO2 gas diverter pipe 170) safely away from the work area.

Figure 2:
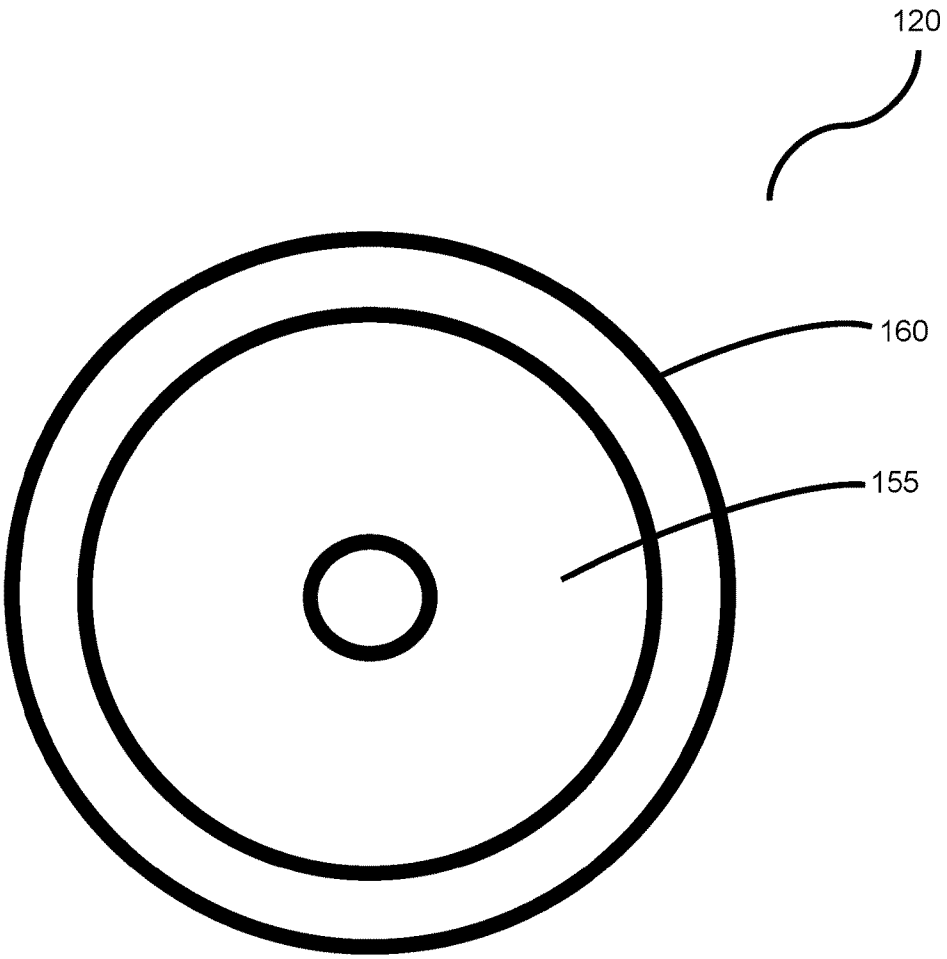
FIG. 2 shows a top view of a disk that is part of the disk interval isolation assembly 123, in accordance with various embodiments.
Figure 3:
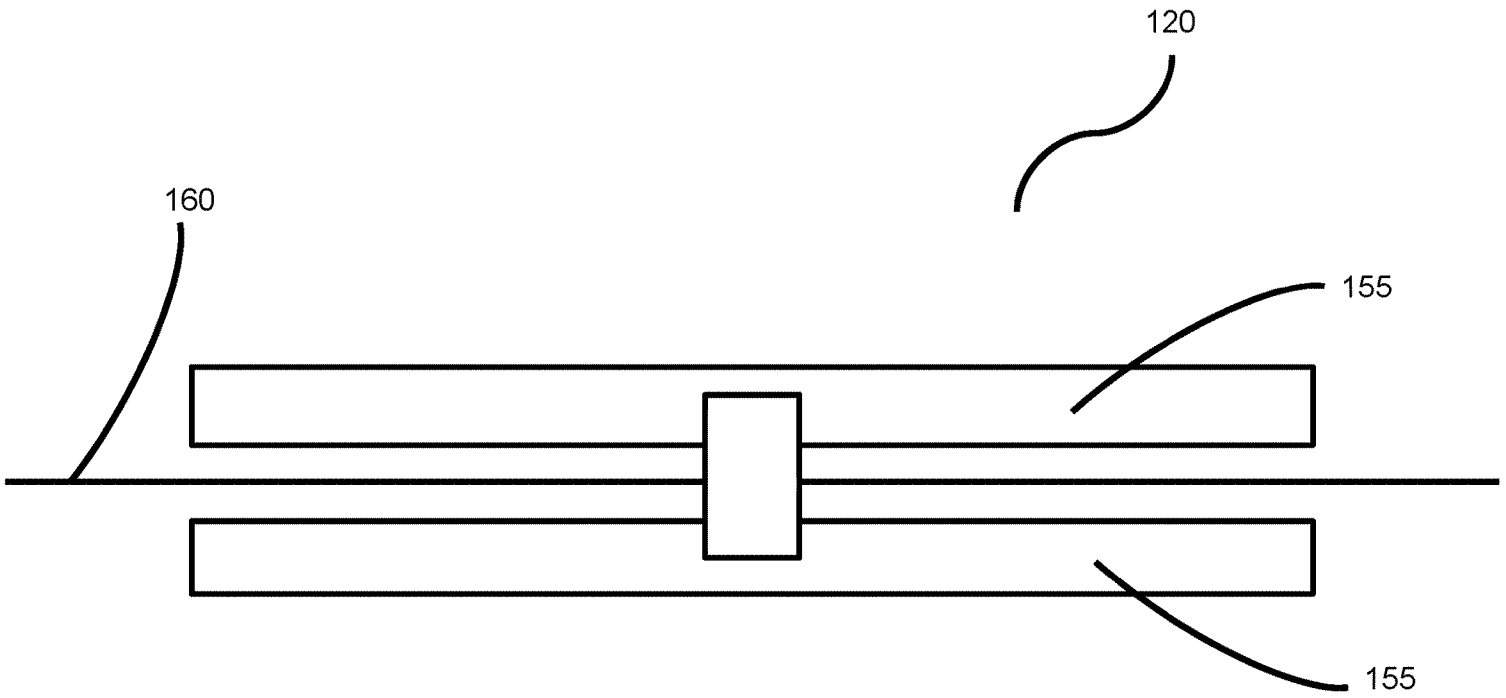
FIG. 3 shows a side view of a disk that is part of the disk interval isolation assembly 123, in accordance with various embodiments.

In various embodiments, and as set forth in FIGS. 2 and 3, the disk interval isolation assembly 123 consists of upper disk 120 and lower disk 122 with a perforated (e.g., screened casing 115) eductor pipe 110 separating them. The upper disk 120 and lower disk 122 may be any shape. Each disk may be fabricated from any material and in any size. In various embodiments, the upper disk 120 and lower disk 122 may be similar size or identically constructed. In various embodiments, each disk is constructed from two steel cylindrical plates 155. Each steel plate 155 may be about 0.25-inch thick with a Schedule 80 steel coupling. The diameter of the plates may be about 80% of the diameter of the casing of well 105. The two plates may be joined together with a cylindrical piece of about 0.25-inch rubber 160 between the two disks 120, 122. The diameter of the rubber 160 is approximately 110% of the diameter of the casing of well 105. The rubber portion may cup up when the disks 120, 122 are pushed down into the well, and the rubber portion cups down when the disks 120, 122 are pulled toward the surface of the well 105. The disks 120, 122 provide a good seal (e.g., holds about 200 psi) during the interval pumping of liquid CO2 125 and prevents over pressurizing with the rubber 160 portion releasing excess pressure.

Figure 4:
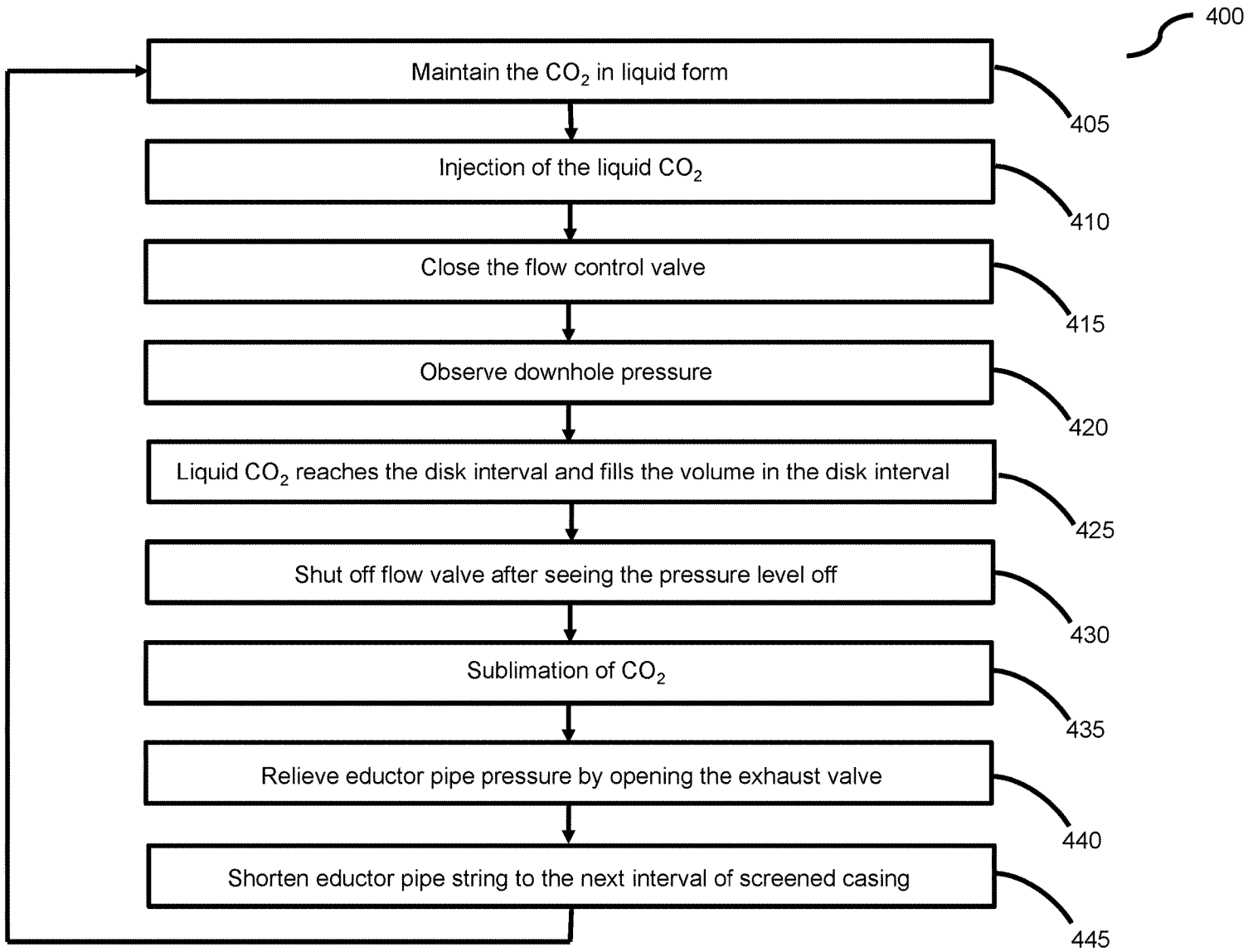
FIG. 4 is a flowchart showing an exemplary process for interval delivery of liquid carbon dioxide, in accordance with various embodiments.

With respect to FIG. 4, a method 400 for interval delivery of liquid carbon dioxide is disclosed. In various embodiments, the vessel holding the liquid CO2 125 maintain the CO2 in liquid form (e.g., at about 280 psi). (Step 405) Based on pressure and volume calculations discussed above, liquid CO2 125 volume is metered and pressures monitored closely during injection. The flow valve 145 is opened to allow the injection of the CO2 (Step 410). The injection results in pushing the water through the eductor pipe 110 which initially increases the pressure in the system relative to the height of the water column. Liquid CO2 will stay in liquid form if the injection pressure remains above 76 psig (psi gauge). Therefore, the system tries to maintain the pressure above 76 psig, so the liquid CO2 125 is maintained in the liquid phase during injection. In response to the calculated volume being injected into the isolated interval, the flow valve 145 is closed (Step 415) and downhole pressure is observed. (Step 420) When the CO2 reaches the disk interval isolator assembly 123 and fills the volume in the disk interval isolator assembly 123 (and the water is pushed out of that portion of the eductor pipe 110), the pressure may level off relative to the water column height. (Step 425) This initial CO2 introduction process may take about 2 minutes. In response to seeing the pressure level off, the flow valve 145 is shut off. (Step 430) During about the next 3-4 minutes, the CO2 goes through sublimation. (Step 435) The sublimation causes the pressure to increase relative to the water column height. Downhole pressure may reduce and stabilize in response to the liquid CO2 125 sublimation process being established. In response to the liquid CO2 125 moving outside of the casing and into the about 25% volume outside the casing, the pressure drops (and may drop to 0 psi). The liquid CO2 125 may return back into the bore of the well 105 and raise the pressure again relative to the water column height. Such method 400 using system 100 may clean a 60 foot section of the eductor pipe 110 and well casing in 10 minutes, wherein the well casing is about 20 inches in diameter and the eductor pipe 110 is about 2 inches in diameter. The eductor pipe 110 pressure can then be relieved by opening the exhaust valve 150 to allow the CO2 gas to exit. (Step 440)

In various embodiments, the perforated length of educator pipe (e.g., screened casing 115) remains constant. The string of eductor pipe 110 sections are then shortened by removing sections (or lengths) of blank pipe at the surface. By removing the pipe sections at the surface, the perforated length of educator pipe (e.g., screened casing 115) is raised to the next section of the well (Step 445), and the process may be repeated.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims.

Any reference to attached, fixed, connected or the like may include permanent, removable, temporary, partial, full and/or any other possible attachment option. Additionally, any reference to without contact (or similar phrases) may also include reduced contact or minimal contact. Different cross-hatching is used throughout the figures to denote different parts but not necessarily to denote the same or different materials. Surface shading lines may be used throughout the figures to denote different parts or areas but not necessarily to denote the same or different materials. In some cases, reference coordinates may be specific to each figure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

The invention claimed is:

1. An interval isolation assembly comprising:

an eductor pipe configured for introducing liquid CO2 within a water well having a well wall;

an upper disk configured for forming an upper boundary for a perforated section of the eductor pipe and the liquid CO2 between the eductor pipe and the well wall; and a lower disk configured for forming a lower boundary for the perforated section of the eductor pipe and the liquid CO2 between the eductor pipe and the well wall, wherein the upper disk and the lower disk both include a releasable disk between two metal plates that provides a seal during injection of the liquid CO2, wherein the upper disk and the lower disk are configured for isolating liquid CO2 between the upper boundary and the lower boundary; and wherein at least a portion of each of the releasable disks is configured to relieve pressure between the upper boundary and the lower boundary, in response to increased pressure between the upper boundary and the lower boundary.

2. The assembly of claim 1, wherein the portion of the eductor pipe outside of the upper boundary and the lower boundary includes a non-perforated wall.

3. The assembly of claim 1, wherein the releasable disk has a larger diameter than the two metal plates.

4. The assembly of claim 1, wherein, in response to removing portions of the eductor pipe, the eductor pipe is shorter which causes the perforated portion of the eductor pipe to be located toward the surface of the well.

5. The assembly of claim 1, wherein the upper disk includes the releasable disk comprised of rubber that cups up and down against the well wall.

6. The assembly of claim 1, wherein the upper disk and the lower disk are configured to raise towards a top of the water well, in response to removing sections of a top portion of the eductor pipe.

7. The assembly of claim 1, wherein the eductor pipe receives a center of the upper disk and a center of the lower disk.

8. The assembly of claim 1, further comprising a supply line that supplies the liquid CO2 into the eductor pipe.

9. The assembly of claim 1, wherein the liquid CO2 emanates from the eductor pipe between the upper disk and the lower disk.

10. The assembly of claim 1, further comprising a diverter tree within a top of the water well.

11. The assembly of claim 1, further comprising a gas diverter pipe from the well.

12. The assembly of claim 1, further comprising a gas diverter pipe from a diverter tree within a top of the well.

13. The assembly of claim 1, further comprising an exhaust valve.

14. The assembly of claim 1, further comprising a pressure gauge in an injection pipe that provides the liquid CO2.

15. The assembly of claim 1, further comprising a flow valve in an injection pipe that provides the liquid CO2.

16. The assembly of claim 1, further comprising a flow meter in an injection pipe that provides the liquid CO2.

17. A method comprising:

injecting liquid CO2 into a perforated portion of an eductor pipe between an upper disk and a lower disk within a first section of a well during a first time period, wherein the upper disk forms an upper boundary for the perforated portion of the eductor pipe and the liquid CO2 between the eductor pipe and the well wall in the first section of the well, wherein the lower disk forms a lower boundary for the perforated portion of the eductor pipe and the liquid CO2 between the eductor pipe and the well wall in the first section of the well, and wherein the upper disk and the lower disk both include a releasable disk between two metal plates that provides a seal during the injection of the liquid CO2;

relieving pressure between the upper boundary and the lower boundary by releasing at least a portion of at least one of the releasable disks, in response to increased pressure between the upper boundary and the lower boundary; and injecting liquid CO2 into the perforated portion of the eductor pipe between the upper disk and the lower disk within a second section of the well during a second time period, wherein the upper disk forms the upper boundary for the perforated portion of the eductor pipe and the liquid CO2 between the eductor pipe and the well wall in the second section of the well, and wherein the lower disk forms the lower boundary for the perforated portion of the eductor pipe and the liquid CO2 between the eductor pipe and the well wall in the second section of the well.

18. The method of claim 17, further comprising removing portions of the eductor pipe to shorten the eductor pipe, wherein the shortening of the eductor pipe causes the perforated portion of the eductor pipe to move to the second section of the well and toward the surface of the well.

19. The method of claim 17, further comprising relieving pressure in the eductor pipe.

* * * * *